United States Patent [19]

Keegan

[11] 4,018,446

[45] Apr. 19, 1977

[54] BOARD GAME

[76] Inventor: Thomas E. Keegan, 404 Green Valley Drive, Naperville, Ill. 60540

[22] Filed: Jan. 13, 1975

[21] Appl. No.: 540,406

[52] U.S. Cl. ..... 273/136 F; 273/131 B; 273/132

[51] Int. Cl.[2] ..... A63F 3/00

[58] Field of Search ..... 273/130, 131, 132, 136

[56] References Cited

UNITED STATES PATENTS

| | | | |
|---|---|---|---|
| 275,526 | 4/1883 | Sackett | 273/132 |
| 753,266 | 3/1904 | Hubbard | 273/132 |
| 898,321 | 9/1908 | Clark | 273/132 |
| 1,421,656 | 7/1922 | Abele | 273/130 R |
| 3,814,433 | 6/1974 | Mellor | 273/132 |

*Primary Examiner*—Delbert B. Lowe

[57] ABSTRACT

A board game consisting of a planar bottom base having upwardly extending sidewalls and end walls. A plurality of strip members extend upwardly from a top surface of the bottom base and communicate between the end walls and are evenly spaced between the sidewalls. Movable playing members are slidably contained in the tracks formed between the strip members. A line parallel to the ends of the board divides the board into two sections. Each player moves a number of playing members within the tracks from one end of the board to the other end. The player forced into moving the last playing member is the loser of the game.

7 Claims, 4 Drawing Figures

BOARD GAME

SUMMARY OF THE INVENTION

My invention relates to a unique and novel board game containing movable playing pieces in elongated tracks. A plurality of U.S. Patents describe various board games; however, these U.S. Patents are non-related to my present invention.

It is an object of my present invention to provide a board game having movable pieces slidably contained in a plurality of elongated tracks.

A further object of my present invention is to provide a board game wherein skill and not luck is the predominant factor.

A still further object of my present invention is to provide a board game of entertainment universally acceptable to all age groups.

Briefly, my present invention comprises a planar bottom base having upward extending sidewalls and endwalls. A plurality of strip members extend upward from a top surface of the bottom base, wherein the strips communicate between the endwalls and are evenly spaced between the sidewalls. Movable playing members are slidably contained in the formed tracks between the strip members. A line parallel to the ends of the board divides the board into two sections. Each player moves a number of playing members within the tracks from one end of the board to the other end. The player forced into moving the last playing piece is the loser of the game.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
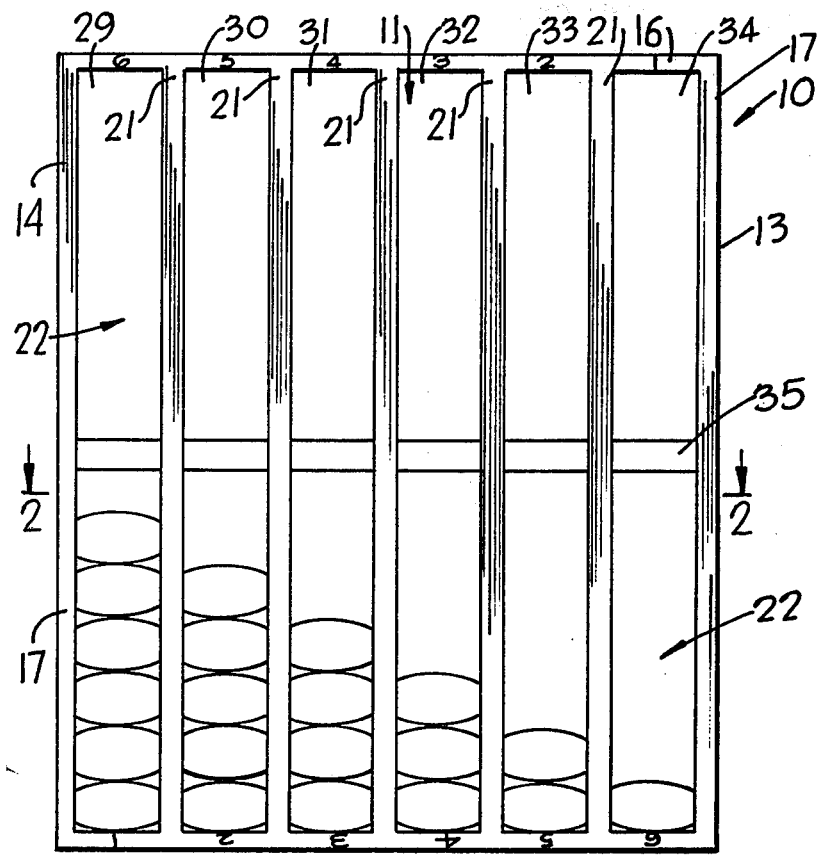
FIG. 1 illustrates a top view of the game board.
Figure 3:
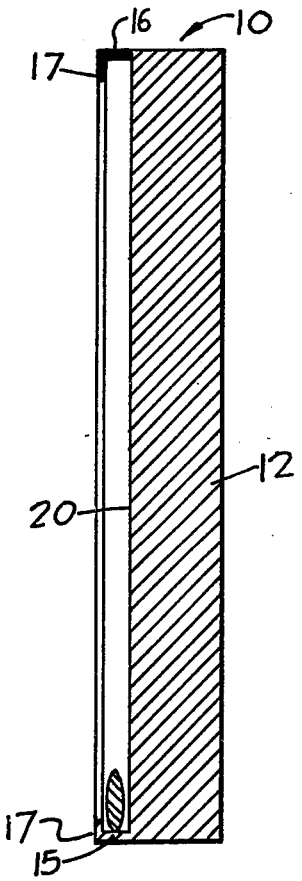
FIG. 3 illustrates a side view of the game board.
Figure 2:
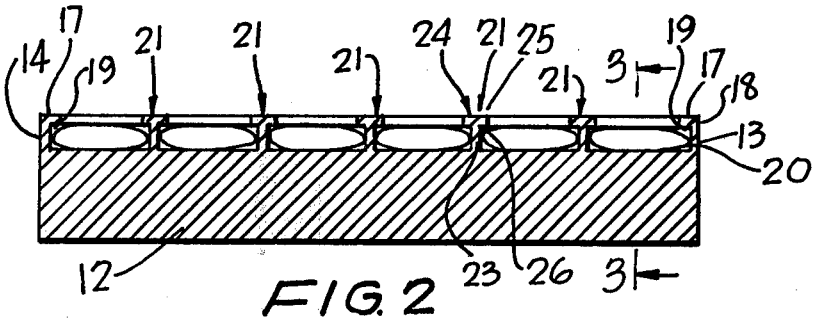
FIG. 2 illustrates an end view of the game board.

Turning now descriptively to the drawings, in which similar reference characters denote similar elements throughout the several views, FIGS. 1, 2, 3 show a board game 10 called "Last". The playing board 11 comprises a rectangular shaped planar bottom base 12 having upwardly extending sidewalls 13, 14 and end walls 15, 16. A planar flange 17 is affixed perpendicularly to the top of each sidewall 13, 14 and each endwall 15, 16, the flanges 17 extending inward over the playing board 11 such that a first channel 19 as shown in FIG. 2 is formed by the flange 17, sidewall 13 and top surface 20 of the playing board 11. Five strip members 21 extend vertically upwardly from the top surface of the board 11, the strips communicating between a first endwall 15 and a second endwall 16. The strip members 21 are evenly spaced between the sidewalls 13, 14, forming six elongated tracks 22.

Each strip member 21 as shown in FIG. 2 consists of an elongated T shaped member having a bottom leg 23 and top cross bar 24. The base of leg 23 is perpendicularly affixed to the top surface 20 of board 11. Each end 25 of each cross bar 24 extends over one of the tracks 22, and a plurality of channels 26 are formed by legs 23, the ends of cross bars 24 and the top playing surface 20 of the board 11.

Figure 4:
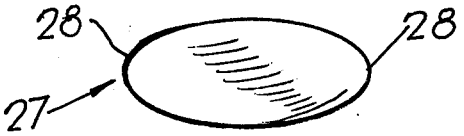
FIG. 4 illustrates a top view of a playing member.

FIG. 4 shows an elliptically shaped playing member 27. A plurality of these playing members 27 are slidably contained within the six tracks 22, the ends 28 of playing members 27 fitting into channels 19, 26.

As clearly can be seen in FIG. 1, the playing members 27 can be moved back and forth within the six tracks 22 between the end walls 15, 16 of the board 11. The number of playing members 27 employed are as follows:

a. Track 29 — six playing members;
b. Track 30 — five playing members;
c. Track 31 — four playing members;
d. Track 32 — three playing members;
e. Track 33 — two playing members;
f. Track 34 — one playing member.

A colored line 35 is marked across the center of board 11 between the medians of the first and second sidewalls 13 and 14.

Any number of players can participate, but for illustrative purposes two players shall be used. All the playing members 27 are moved to the first end 16 of the board 11. The first player moves any number of playing members 27 in a given track 22 across line 35 to the second end 15 of the board 11. All or some of members 27 in a given track 22 can be moved but only the members 27 in one track can be used for a given play. The process is repeated by each player until one playing member 27 remains in one track 22. The player forced to move this last playing member 27 across line 35 is the loser of the game.

Obvious changes may be made in the specific embodiment of the invention described herein, such modifications being within the spirit and scope of the invention claimed, and it is indicated that all matter contained herein is intended as illustrative and not as limiting in scope.

Having thus described the invention, what I claim as new and desire to secure by Letters Patent of the United States is:

1. A game board, which comprises:

a. a flat bottom base having a top planar playing surface;
b. a pair of upwardly extending sidewalls and end walls affixed to said base;
c. a plurality of strip members affixed perpendicularly to said top playing surface of said bottom base, each said strip member extending between said endwalls, said strip members evenly spaced between said sidewalls and forming a plurality of elongated tracks, each said strip member being of a T-shaped configuration having a top cross bar and a downwardly extending leg, said leg affixed perpendicularly to said top playing surface, one end of said cross bar, said top playing surface and said leg forming an elongated channel;
d. flange members affixed perpendicularly to a top of each said sidewall and each said endwall, each said flange member extending over said elongated tracks, said flange member, said sidewall, and said top playing surface forming an elongated channel; and
e. a plurality of playing members retained by said flange members within said channels, said playing members of a shape to be movable back and forth within said channels.

2. A game board as recited in claim 1, wherein a center line extends perpendicularly across said tracks dividing said playing board into two sections.

3. A game board as recited in claim 1, wherein said playing members are elliptical in shape.

4. A game board as recited in claim 3, wherein the ends of said elliptically shaped members are slidably contained within said elongated channels.

5. A game board as recited in claim 1, wherein said strip members number five, forming six said tracks.

6. A game board as recited in claim 5, wherein said playing members number twenty-one, being contained in said six tracks.

7. A game board as recited in claim 6, wherein said twenty-one playing members are subdivided into six groups consisting of six, five, four, three, two and one.

* * * * *